US008337251B2

(12) United States Patent
Ecker

(10) Patent No.: US 8,337,251 B2
(45) Date of Patent: Dec. 25, 2012

(54) TOLERANCE-COMPENSATING CURRENT DISTRIBUTION BOARD

(75) Inventor: Stefan Ecker, Vilsbiburg (DE)

(73) Assignee: Lisa Dräxlmaier GmbH, Vilsbiburg (DE)

( * ) Notice: Subject to any disclaimer, the term of this patent is extended or adjusted under 35 U.S.C. 154(b) by 445 days.

(21) Appl. No.: 12/310,590

(22) PCT Filed: Aug. 29, 2007

(86) PCT No.: PCT/EP2007/058981

§ 371 (c)(1),
(2), (4) Date: Jun. 21, 2010

(87) PCT Pub. No.: WO2008/025792

PCT Pub. Date: Mar. 6, 2008

(65) Prior Publication Data

US 2010/0261377 A1 Oct. 14, 2010

(30) Foreign Application Priority Data

Aug. 31, 2006 (DE) ..... 10 2006 040 824

(51) Int. Cl.
*H01R 13/68* (2011.01)

(52) U.S. Cl. ..... 439/620.27

(58) Field of Classification Search ..... 439/629.27, 439/721, 722, 723, 724, 620.27
See application file for complete search history.

(56) References Cited

U.S. PATENT DOCUMENTS 4,273,408 A * 6/1981 Orr ..... 439/737
4,432,594 A * 2/1984 Daggett ..... 439/698
4,842,534 A * 6/1989 Mobley et al. ..... 439/214
5,023,752 A * 6/1991 Detter et al. ..... 361/752
5,088,940 A 2/1992 Saito
5,433,628 A 7/1995 Sadaishi et al.
5,438,310 A * 8/1995 Ikari ..... 337/208
5,474,475 A * 12/1995 Yamaguchi ..... 439/620.27
5,643,693 A * 7/1997 Hill et al. ..... 429/121
5,788,519 A * 8/1998 Stern ..... 439/189
5,795,193 A * 8/1998 Yang ..... 439/620.27
5,866,848 A * 2/1999 Asselta et al. ..... 174/72 B
6,036,554 A * 3/2000 Koeda et al. ..... 439/797
6,126,493 A * 10/2000 Price et al. ..... 439/801
6,206,718 B1 * 3/2001 Takahashi et al. ..... 439/382
6,302,709 B1 * 10/2001 Ross ..... 439/78
6,402,569 B1 * 6/2002 Spadoni et al. ..... 439/723
6,476,705 B1 11/2002 Betti et al.
6,509,824 B2 * 1/2003 Inaba et al. ..... 337/295
6,545,861 B1 * 4/2003 Hayes et al. ..... 361/642
6,607,392 B2 * 8/2003 Kondoh ..... 439/92
6,624,356 B2 * 9/2003 Sumida et al. ..... 174/59

(Continued)

FOREIGN PATENT DOCUMENTS

DE 296 20 424 U1 11/1996

(Continued)

*Primary Examiner* — Neil Abrams

(74) *Attorney, Agent, or Firm* — Wolf, Greenfield & Sacks, P.C.

(57) ABSTRACT

A tolerance-compensating current distribution board, in particular for motor vehicles, is provided, which comprises a stamped laminate with a contact region with contact lugs and a fastening region, which rests on a side of the stamped laminate which is opposite the contact region, wherein the fastening region lies at one end of a tongue, which is substantially parallel to the contact region and whose other end is connected to the contact region.

14 Claims, 1 Drawing Sheet

U.S. PATENT DOCUMENTS

| | | | | |
|---|---|---|---|---|
| 6,759,938 | B2 * | 7/2004 | Matsumura et al. | 337/161 |
| 6,822,331 | B2 * | 11/2004 | Eytcheson | 257/773 |
| 6,824,430 | B2 * | 11/2004 | Matsumura et al. | 439/620.29 |
| 6,875,053 | B2 * | 4/2005 | Fujii et al. | 439/567 |
| 7,077,704 | B2 * | 7/2006 | Ikeda et al. | 439/627 |
| 7,234,454 | B2 * | 6/2007 | Tauchi et al. | 123/634 |
| 7,396,262 | B2 * | 7/2008 | Korczynski et al. | 439/723 |
| 7,599,186 | B2 * | 10/2009 | Gardin | 361/704 |
| 7,663,465 | B2 * | 2/2010 | Matsumoto et al. | 337/187 |
| 7,670,184 | B2 * | 3/2010 | Akahori et al. | 439/620.27 |
| 7,990,738 | B2 * | 8/2011 | Urrea et al. | 361/833 |
| 8,130,070 | B2 * | 3/2012 | Shibata | 337/283 |
| 8,137,116 | B2 * | 3/2012 | Omori et al. | 439/92 |
| 2002/0009909 | A1 | 1/2002 | Kondoh | |
| 2008/0050981 | A1 * | 2/2008 | Pavlovic et al. | 439/701 |
| 2010/0261377 | A1 * | 10/2010 | Ecker | 439/507 |

FOREIGN PATENT DOCUMENTS

| | | | |
|---|---|---|---|
| DE | 299 12 797 | U1 | 7/1999 |
| EP | 1 075 012 | A2 | 2/2001 |
| GB | 2 279 822 | A | 1/1995 |

* cited by examiner

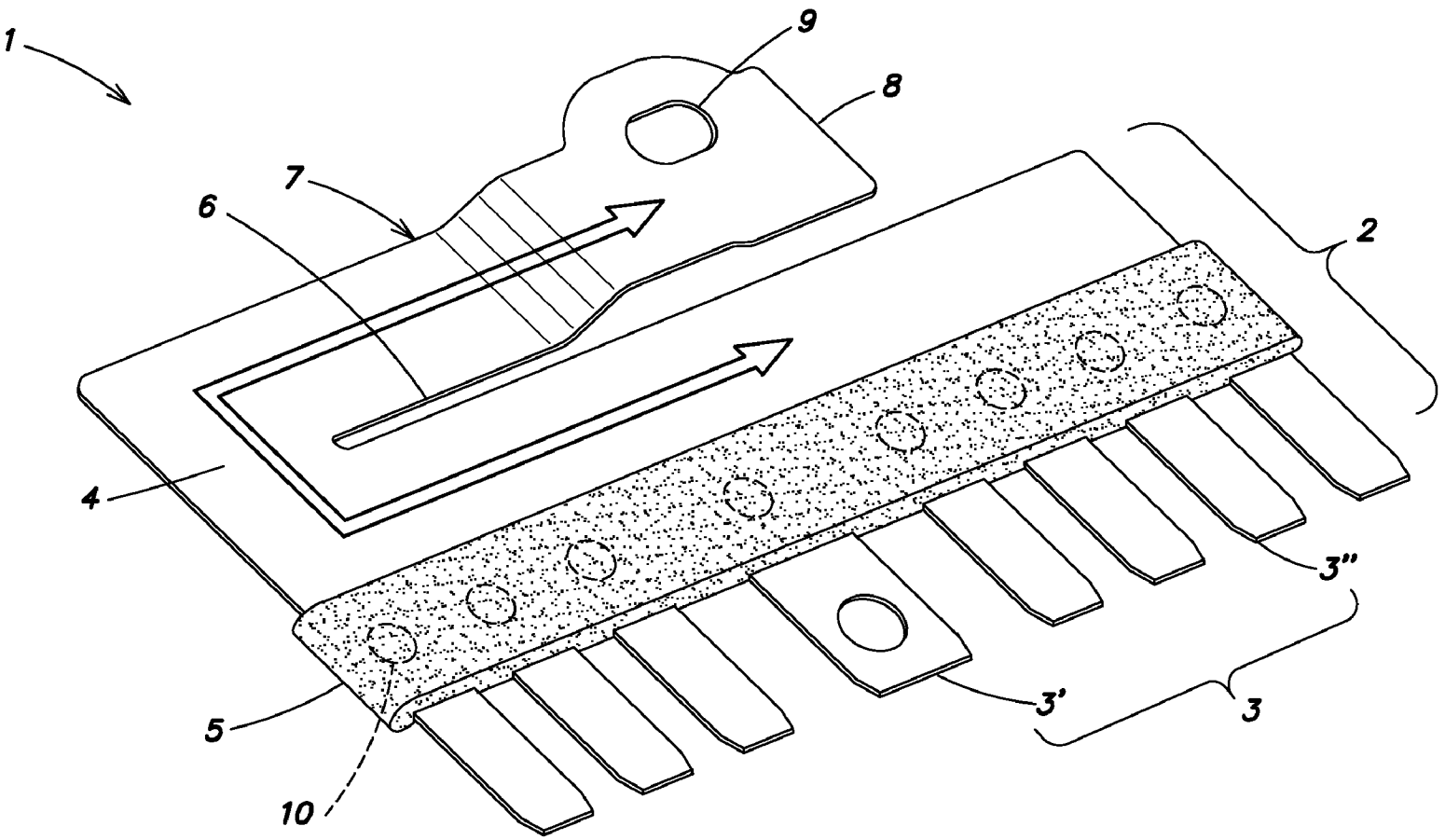
1
2
3
3'
3''
4
5
6
7
8
9
10

TOLERANCE-COMPENSATING CURRENT DISTRIBUTION BOARD

FIELD OF THE INVENTION

The present invention relates to a current distribution board, which compensates the differences in height or level between its screw-on point and the contacts of the distribution board. Such tolerance-compensating current distribution boards are used in particular in motor vehicles, in the engine compartment for example.

PRIOR ART

Current distribution boards are used in general to provide a plurality of contacts with the same voltage potential for power cables leading to various loads. One example of application is the on-board electrical system of motor vehicles with its various electrical loads such as on-board electronics, hi-fi system, interior lighting, air-conditioning system, etc. In this case, the current distribution board usually comprises a punched sheet with one input contact and a plurality of output contacts and is attached at a point, in the engine compartment for example, to the car body in order to ensure secure connection of incoming and outgoing conductors which are fixed to a support surface. Moreover, such current distribution boards may also be provided with integrated fusible cut-outs which are also known, for example, as SF-30, SF-51 or multifuse according to the specifications arising from the connection geometry.

Especially in motor vehicles, however, vibrations and displacements arise between components, which bring about a relative displacement between the attachment point (e.g. a screw-on point) of the current distribution board and the support surface of the contacts with the connected conductor terminals and which may lead to the terminals or the contacts bending, breaking or being otherwise damaged. Furthermore, tolerances may arise during manufacture or assembly of the components. Until now, height differences or tolerances between a current distribution board support surface and the screw-on point of the current distribution board were compensated with the help of additional tolerance sheets. Due to the small amount of space available between the screw-on point and the support surface, this tolerance sheet was produced in a material that was more flexible compared to the material of the current distribution board, for example from a thinner metal sheet so as to absorb the forces arising during loading or displacement via the tolerance plate and not to damage the current distribution board.

The disadvantage of this solution is that it is necessary to use several components with different properties and materials. It is also necessary to use different tools to produce these components and additional production steps have to be performed up to the installation of the current distribution board. Thus, for example, the additional tolerance plate itself has to be produced separately due to the difference in material between it and the punched sheet of the current distribution board, and then it has to be suitably joined to the punched sheet by means of riveting, Tox joining (Tox® joining method) or the like.

SUMMARY OF THE INVENTION

Accordingly, it is the object of the present invention to overcome the mentioned disadvantages of the prior art and to provide a current distribution board which compensates tolerances between the attachment point and the contact support surface, and is at the same time easy to manufacture.

This object is achieved by means of a tolerance-compensating current distribution board having the features of claim 1. Further advantageous embodiments emerge from the remaining claims.

The tolerance-compensating current distribution board according to the invention may be used in particular in motor vehicles and comprises a punched sheet with a contact region having contact tabs and an attachment region positioned on a side of the punched sheet opposite to the contact region, wherein the attachment region is situated at one end of a tongue which is substantially parallel to the contact region and the other end of which is connected to the contact region. In this case, the contact region is formed from a punched sheet having a longitudinal extension with individual contact tabs being disposed along the first long side. The attachment region is disposed in one piece by way of the tongue, on the second long side facing away from the contact tabs, wherein the tongue connects at or close to a long end of the contact region.

Due to this configuration, it is now possible to guide the bending section, along which tolerances arising are compensated, instead of as previously via the shortest, direct path between the contact support surface and the attachment region, via a considerably extended path which runs substantially from a point of application of the bending force on the contact support surface on the punched sheet parallel to the contact region and via the connection region onto the tongue and finally to the other point of application of the bending force on the attachment region. It thus becomes possible to implement the necessary tolerance compensation by utilising the same installation space as in the prior art but using only one component or one material in the process. As the current distribution board comprises only one component with, for example, a constant sheet thickness, it is furthermore possible to use only one punch-bending tool and a simple manufacturing process. At the same time, it is possible, by means of the current distribution board so designed, to compensate both thermal and mechanical stresses such that no damaging mechanical forces are transmitted to the contact region and the contact tabs with the attached connectors.

It is advantageous for the tongue to connect the attachment region resiliently to the contact region. Although a plastic deformability of the tongue enables tolerance compensation, too, a resilient connection enables a more secure connection due to the longer service life.

Preferably, the attachment region is bent in relation to the tongue such that it lies in a plane which is substantially parallel to the plane of the contact region, i.e. to the main extension of the punched sheet. This bending enables optimum tolerance compensation due to a selective adaptability of the bend to the height difference, by means of which additional bending moments arising in a non-parallel arrangement are prevented. In addition, the length of the tongue available for elastic tolerance compensation is increased.

In a preferred embodiment, the attachment region includes a screw hole through which the current distribution board may be attached to a support. From an assembly point of view, a screw connection represents the simplest and most easily automated type of attachment of the current distribution board. Of course, other types of attachment may be used according to circumstances, e.g. clamped, riveted or welded joints.

Particularly preferably, the contact tabs are disposed in a row. This contributes towards a clear and orderly arrangement of the conductors to be connected and helps particularly when connecting wiring looms. Other arrangements may be provided according to the specific wiring conditions in each case, such as e.g. two offset rows positioned side-by-side or rows with different sizes of contact tabs.

The tongue is preferably separated from the contact region by means of a slot which partially cuts into the punched sheet and runs substantially parallel to the contact region. This configuration is particularly easy to produce in terms of manufacture using a punch-bending device.

The punched sheet preferably has a constant thickness in all regions. Therefore, it is possible due to lower material costs (no sheets of different thicknesses, no wedge profiles, etc.) to implement a current distribution board that is manufactured particularly cost-effectively.

BRIEF DESCRIPTION OF THE DRAWING

A preferred embodiment of the tolerance-compensating current distribution board according to the invention is described in the following based on the drawing attached, wherein FIG. 1 shows a perspective view of a preferred embodiment of the invention.

BEST MODE OF CARRYING OUT THE INVENTION

The current distribution board 1 illustrated in FIG. 1 comprises a punched sheet and includes a substantially rectangular contact region 2, along the long side of which a row of contact tabs 3 is formed, one of which may be defined as screw contact 3' and the others as plug-in contacts 3". The contact region 2 further includes an insulator 5 made of plastic, under which fusible cut-outs 10 (shown schematically in FIG. 1) associated with each contact lug are provided. Insulator 5 is also used as reinforcement which prevents bending of the contact tabs when connectors (e.g. terminals) are pushed on.

The punched sheet has already been formed with a slot 6 during manufacture such that the punched sheet is divided into the contact region and a further region, which comprises the tongue 7 and the attachment region 8 joined in one piece thereto. In the illustrated embodiment, the slot runs parallel to the longitudinal extension of the contact region and thus to the row of contact tabs. In this case, the attachment region is provided almost centrally along the side opposite to the contact region and is bent upwards to be coplanar by means of a corresponding deformation during punch-bending and is provided with an oblong screw hole 9. Due to this upward bending, which may be stepped or stepless, the attachment region 8 with the screw point and the contact support region 2 with contact tabs 3 are therefore located in two parallel planes offset in relation to each other in order to thus compensate an already defined difference in height. To compensate dynamic tolerances, the tongue 7 then resiliently connects the attachment region to the contact region, whereby this connection 4 is positioned laterally (in relation to its main axis) on the tongue.

The current distribution board 1 illustrated is able, due to this configuration of the tongue 7 and of the slot 6 defining it, to effectively compensate bending forces acting on the current distribution board 1 via a long bending section (see double arrow in FIG. 1). It is then no longer necessary to compensate the bending load on the direct bending section using high radii of curvature of the material, and comparatively small radii of curvature may be used to compensate via a long bending section. The geometrical design of the bending section, that is to say substantially u-shaped, additionally enables compensation of bending loads (tolerances) from different directions.

Of course, further modifications of the embodiment described, which lie within the scope of the attached claims, will be obvious to the person skilled in the art.

The invention claimed is:

1. A tolerance-compensating current distribution board comprising a punched sheet extending in a longitudinal direction and having a contact region having contact tabs on a first longitudinal side of the punched sheet, the punched sheet also having an attachment region on a second longitudinal side of the punched sheet opposite to the contact region and facing away from the contact tabs, wherein the attachment region is situated at one end of a tongue which is separated from the contact region by a slot which cuts partially into the punched sheet and extends in the longitudinal direction, and an other end of the tongue is joined to the contact region.

2. The current distribution board according to claim 1, wherein the tongue resiliently connects the attachment region to the contact region.

3. The current distribution board according to claim 1, wherein the attachment region is bent in relation to the tongue such that the attachment region lies in a plane which is substantially parallel to a plane of the contact region.

4. The current distribution board according to claim 1, wherein the attachment region comprises a screw hole, through which the current distribution board may be attached to a support.

5. The current distribution board according to claim 1, wherein the contact tabs are disposed in a row.

6. The current distribution board according to claim 1, wherein the tongue is substantially parallel to the contact region.

7. The current distribution board according to claim 1, wherein the punched sheet has a constant thickness in all regions.

8. The current distribution board according to claim 1, wherein fusible cut-outs, which are surrounded by at least one an insulator, are respectively provided between the contact tabs and the contact region.

9. The current distribution board according to claim 1, wherein the tongue and the contact region lie in the same plane.

10. The current distribution board according to claim 1, wherein the attachment region lies in a plane that is generally parallel to but offset from a plane of the tongue and the contact region.

11. A current distribution board comprising;

a U-shaped punched sheet of constant thickness, the sheet including:

a contact region defined by a first leg of the U-shaped punched sheet and having a contact region body;

an elongate tongue defined by a second leg of the U-shaped punched sheet and having a first end joined to the contact region body and a second free-end;

an attachment region joined to the second free-end of the tongue; and at least one contact tab extending perpendicularly from the first leg.

12. A current distribution board comprising:

a U-shaped punched sheet of constant thickness, the sheet including:

a longitudinally extending first leg of the U-shaped sheet defining a contact region;

a plurality of contact tabs extending generally perpendicular to the longitudinally extending first leg;

a second leg of the U-shaped sheet defining a tongue extending generally parallel to the contact region; and an elongate slot formed between the contact region and the tongue to thereby free at least a portion of the tongue from the contact region to form a cantilevered tongue whereby one end of the tongue is attached to the contact region and the other end of the tongue is a free end; and an attachment region joined to the free end of the tongue.

13. The current distribution board according to claim 12, wherein the tongue and the contact region lie in the same plane.

14. The current distribution board according to claim 13, wherein the attachment region lies in a plane that is generally parallel to but offset from a plane of the tongue and the contact region.

* * * * *

UNITED STATES PATENT AND TRADEMARK OFFICE

CERTIFICATE OF CORRECTION

PATENT NO. : 8,337,251 B2
APPLICATION NO. : 12/310590
DATED : December 25, 2012
INVENTOR(S) : Stefan Ecker It is certified that error appears in the above-identified patent and that said Letters Patent is hereby corrected as shown below:

On the Title page, in item (30), replace "10 2006 040 824" with --10 2006 040 824.1--

Item (30) should read: Aug. 31, 2006 (DE) ..... 10 2006 040 824.1

At column 4, claim 11, line 51, replace "comprising;" with --comprising:--

Signed and Sealed this
Second Day of April, 2013

Teresa Stanek Rea
*Acting Director of the United States Patent and Trademark Office*